US008467692B2

(12) United States Patent
Fukazawa

(10) Patent No.: US 8,467,692 B2
(45) Date of Patent: Jun. 18, 2013

(54) IMAGE FORMING APPARATUS AND IMAGE FORMING METHOD

(75) Inventor: Masahiro Fukazawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 408 days.

(21) Appl. No.: 12/707,077

(22) Filed: Feb. 17, 2010

(65) Prior Publication Data

US 2010/0226674 A1 Sep. 9, 2010

(30) Foreign Application Priority Data

Mar. 4, 2009 (JP) ..... 2009-051001

(51) Int. Cl.
*G03G 15/06* (2006.01)

(52) U.S. Cl.
USPC ..... 399/55; 399/237; 399/240

(58) Field of Classification Search
USPC ..... 399/55, 237, 235, 240
See application file for complete search history.

(56) References Cited

U.S. PATENT DOCUMENTS 5,610,694 A * 3/1997 Lior et al. ..... 399/240
5,737,666 A 4/1998 Lior et al.
5,873,011 A 2/1999 Takemoto et al.
7,062,202 B2 6/2006 Kitazawa et al.
7,457,568 B2 11/2008 Kitazawa et al.
7,672,618 B2 3/2010 Kitazawa et al.
2004/0251435 A1 * 12/2004 Sawayama et al. ..... 250/559.16

FOREIGN PATENT DOCUMENTS

JP 09-247459 9/1997
JP 2002-156798 5/2002
JP 2004-117667 4/2004
JP 2005-234430 9/2005
JP 2008-170602 7/2008

* cited by examiner

*Primary Examiner* — Walter L Lindsay, Jr.
*Assistant Examiner* — Barnabas Fekete
(74) *Attorney, Agent, or Firm* — Workman Nydegger

(57) ABSTRACT

An image forming apparatus includes a developing section that includes a feed member having a groove, a developer carrier developing with liquid developer fed from the feed member, and a charging member charging the liquid developer carried in the developer carrier. An image carrier carries an image developed by the developing section. An optical sensor includes a light emitting section emitting light to the image developed in the image carrier. A first light receiving section receives light reflected from the image. A second light receiving section is disposed at a position different from that of the first light receiving section. A control section adjusts a developing bias applied to the developer carrier in response to an output signal of the first light receiving section, and controls a bias applied to the charging member by the output signals of the first and second light receiving sections.

6 Claims, 12 Drawing Sheets

FIG. 11

| DETECTION SIGNAL | | CONTROL | |
|---|---|---|---|
| SCATTERED LIGHT | SPECULAR REFLECTED LIGHT | GRID VOLTAGE OF TONER CHARGER | VOLTAGE OF DEVELOPING ROLLER |
| WITHIN REFERENCE RANGE | WITHIN REFERENCE RANGE | NO CHANGE (0[V] 0[V]) | NO CHANGE |
| | LARGER THAN REFERENCE RANGE | +5[V] (0[V] +5[V]) | +5[V] |
| | SMALLER THAN REFERENCE RANGE | −5[V] (0[V] −5[V]) | −5[V] |
| LARGER THAN REFERENCE RANGE | WITHIN REFERENCE RANGE | +5[V] (+5[V] 0[V]) | NO CHANGE |
| | LARGER THAN REFERENCE RANGE | +10[V] (+5[V] +5[V]) | +5[V] |
| | SMALLER THAN REFERENCE RANGE | NO CHANGE (+5[V] −5[V]) | −5[V] |
| SMALLER THAN REFERENCE RANGE | WITHIN REFERENCE RANGE | −5[V] (−5[V] 0[V]) | NO CHANGE |
| | LARGER THAN REFERENCE RANGE | NO CHANGE (0[V] 0[V]) | +5[V] |
| | SMALLER THAN REFERENCE RANGE | −10[V] (−5[V] −5[V]) | −5[V] |

IMAGE FORMING APPARATUS AND IMAGE FORMING METHOD

BACKGROUND

1. Technical Field

The present invention relates to an image forming apparatus and an image forming method which perform image formation by developing an electrostatic latent image formed on an image carrier by liquid developer having toner and carrier liquid, and transferring and fixing a developed developer image to a recording material.

2. Related Art

Various image forming apparatuses have been proposed in which electrostatic latent images are developed and visualized using high-viscosity liquid developer where toner composed of solid components is dispersed in a liquid solvent used as a carrier liquid. The developer used in the image forming apparatuses is an agent where solid components (toner particles) are suspended in an electrically isolating high-viscosity organic solvent (carrier liquid) composed of silicon oil, mineral oil, cooking oil or the like. Extremely fine particles of which the particle diameter is 1 μm or so are used as the toner particles, a high quality can be achieved compared to dry image forming apparatuses in which a particle diameter of 7 μm is used as in related art.

As the image forming apparatus using such liquid developer, for example, an image forming apparatus in which a developing roller is in contact with a photoreceptor to thereby perform development is disclosed in JP-A-2008-170602, U.S. Pat. No. 5,610,694, and U.S. Pat. No. 5,737,666. In particular, as disclosed in the forty-sixth paragraph of JP-A-2008-170602, when the compressed state of toner is weak, it has known that a vertically streaky image disorder called a rivulet in a developing nip is generated. This phenomenon is attributed to the fact that the movement velocity of the toner particles at the developing nip is not sufficient due to the weak compression of the toner, and thus the press to the photoreceptor is not sufficient, and as a result, the liquid developer causes a cobweb phenomenon in a developing nip outlet formed between the developer carrier and the photoreceptor.

Such a rivulet generated on the photoreceptor (which is called a "developer stripe" in the present specification) affects even an image transferred to a recording material such as paper, to thereby exhibit image unevenness in the transferred image.

On the other hand, one cause which generates image unevenness is attributed to the feed roller (anilox roller). The feed roller is a roller in which a diagonal-shaped groove is formed on the surface finely and uniformly, and feeds the liquid developer drawn up through this groove to the developing roller. A developer pattern generated by the groove typically vanishes when fed to the developing roller, and a thin film of the uniform developer is formed on the developing roller. However, there may be a case where the developer pattern does not vanish even on the developing roller and is transferred due to various types of environmental changes, such as variation in a viscosity of the liquid developer due to the change of temperature, whereby the developer pattern appears as image unevenness on the photoreceptor.

SUMMARY

An advantage of some aspects of the invention is to provide an image forming apparatus and an image forming method capable of performing high-quality image formation by suppressing image unevenness attributed to a developer stripe and a developer pattern due to the groove of the feed roller, and uniformly maintaining a varying image density with the suppression of image unevenness. Therefore, various types of configurations are adopted as follows.

According to a first aspect of the invention, an image forming apparatus is provided, which includes: a developing section that includes a feed member having a groove, a developer carrier developing with liquid developer fed from the feed member, and a charging member charging the liquid developer carried in the developer carrier; an image carrier that carries an image developed by the developing section; an optical sensor that includes a light emitting section emitting light to the image developed in the image carrier, a first light receiving section receiving light reflected from the image, and a second light receiving section disposed at a position different from that of the first light receiving section; and a control section that adjusts a developing bias applied to the developer carrier in response to an output signal of the first light receiving section, and controls a bias applied to the charging member by the output signal of the first light receiving section and an output signal of the second light receiving section.

With this configuration, it is possible to suppress image unevenness, and to uniformly maintain an image density to thereby perform high-quality image formation.

Further, in the image forming apparatus according to the invention, it is preferable that the control section sets the developing bias applied to the developer carrier to a first developing bias, when the output signal of the first light receiving section is a first output value, and that the control section adjusts the developing bias applied to the developer carrier to a second developing bias larger than the first developing bias in absolute value, when the output signal of the first light receiving section is larger than the first output value. With this configuration, it is possible to uniformly maintain an image density by a simple control.

Further, in the image forming apparatus according to the invention, it is preferable that light detected by the first light receiving section is specular reflected light of the light reflected from the image, and light detected by the second light receiving section is scattered light of the light reflected from the image. With this configuration, it is possible to accurately perform detection of the image density and image unevenness.

Further, in the image forming apparatus according to the invention, it is preferable that the control section performs adjustment of the developing bias applied to the developer carrier and adjustment of the bias applied to the charging member, after the predetermined number of recording materials is printed. It is possible to maintain an image quality adapted to the state of the developer or the environmental change by setting an adjustment timing to after the predetermined number of the sheets.

According to a second aspect to the invention, an image forming method is provided, which includes: feeding liquid developer reserved in a developer reservoir to a developer carrier using a feed member having a groove; charging the liquid developer fed to the developer carrier by a charging member; developing a latent image formed on an image carrier by the developer carrier to which a developing bias is applied using the liquid developer charged by the charging member; emitting light to the image developed by the charging member through a light emitting section, receiving light reflected from the image in a first light receiving section, and receiving the light reflected from the image in a second light receiving section disposed at a position different from that of the first light receiving section; and adjusting the developing bias applied to the developer carrier by an output signal of the first light receiving section, and adjusting a bias applied to the charging member by the output signal of the first light receiving section and an output signal of the second light receiving section.

With this configuration, it is possible to suppress image unevenness, and to uniformly maintain an image density to thereby perform high-quality image formation.

Further, in the image forming method according to the invention, it is preferable to further include: setting the developing bias applied to the developer carrier to a first developing bias, when the output signal of the first light receiving section is a first output value; and adjusting the developing bias applied to the developer carrier to a second developing bias larger than the first developing bias in absolute value, when the output signal of the first light receiving section is larger than the first output value. With this configuration, it is possible to uniformly maintain an image density by a simple control.

BRIEF DESCRIPTION OF THE DRAWINGS

The invention will be described with reference to the accompanying drawings, wherein like numbers reference like elements.

FIG. 11 is a table used for the control of the image forming apparatus according to the embodiment of the invention.

DESCRIPTION OF EXEMPLARY EMBODIMENTS

Figure 1:
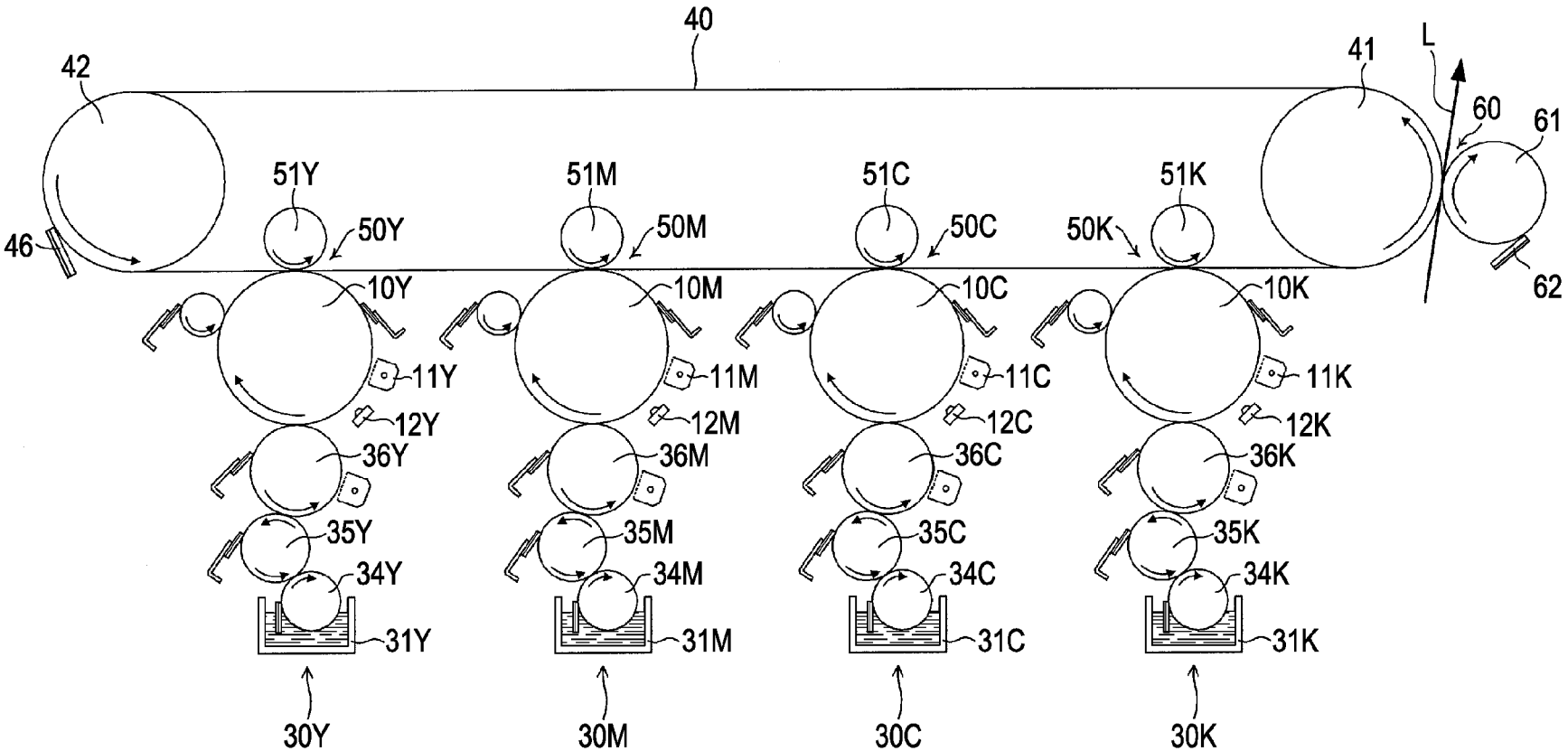
FIG. 1 is a cross-section view illustrating main constituents of an image forming apparatus according to an embodiment of the invention.

Hereinafter, embodiments of the invention will be described with reference to the drawings. FIG. 1 is a diagram illustrating the main constituents of the image forming apparatus according to the embodiment of the invention. With respect to an image forming section disposed in the central portion of the image forming apparatus, four developing devices 30Y, 30M, 30C, and 30K are disposed in the lower portion of the image forming section, and an intermediate transfer body 40 and a secondary transfer section (secondary transfer unit 60) are disposed in the upper portion of the image forming section. Hereinafter, the image forming section and the developing devices 30Y, 30M, 30C, and 30K will be described. However, since the constitutions of each color are identical to each other, the description is made with the subscript alphabets which signify the colors being omitted. Meanwhile, since the image forming apparatus according to the embodiment is configured to be capable of forming a full-color image by four colors of YMCK, the apparatus is not limited to the embodiment, and may be, for example, an image forming apparatus in which the number of the appropriate colors, such as single colors, is adopted.

The image forming section includes an image carrier 10, a corona charger 11, an exposure unit 12 and the like. The exposure unit 12 includes a light source such as an LED or a semiconductor laser, and illuminates light on the basis of an input image signal to form an electrostatic latent image on the charged image carrier 10.

The developing device 30 includes, roughly, a developer container 31 which stores liquid developer of each color, a feed roller 34 which applies the liquid developer from the developer container 31 to an intermediate roller 35 and the like, and develops the electrostatic latent image formed on the image carrier 10 by the liquid developer of each color. The intermediate transfer body 40 is constituted by an endless belt and the like, and is suspended between a driving roller 41 and a tension roller 42 to be rotationally driven by the driving roller 41 while being in contact with the image carrier 10 in a primary transfer section 50. In the primary transfer section 50, the image carrier 10 and a primary transfer backup roller 51 are disposed opposite to each other with the intermediate transfer body 40 being inserted therebetween, and a position in contact with the image carrier 10 is set to a transfer position, whereby toner images of each color on the developed image carrier 10 are sequentially overlapped on the intermediate transfer body 40 and are transferred to form full-color toner images.

In a secondary transfer section 60, a secondary transfer roller 61 is disposed opposite to the driving roller 41 with the intermediate transfer body 40 being inserted therebetween. Further, a secondary transfer roller cleaning section 62 is disposed in a state where a blade thereof is in contact with the secondary transfer roller 61. At a transfer position in the secondary transfer roller 61, the single-color toner images or full-color toner images formed on the intermediate transfer body 40 are transferred to recording materials such as paper, a film, and a textile which are transported through a sheet material transporting path L.

Further, a fixing unit, which is not shown, is disposed downstream of the sheet material transporting path L, and performs fusion of the single-color toner images or the full-color toner images, transferred onto the recording material such as paper, on the recording material such as paper to thereby fix them. In addition, the tension roller 42 suspends the intermediate transfer body 40 along with the driving roller 41, and an intermediate transfer body cleaning section 46 is disposed in contact with a place suspended on the tension roller 42 of the intermediate transfer body 40.

Figure 2:
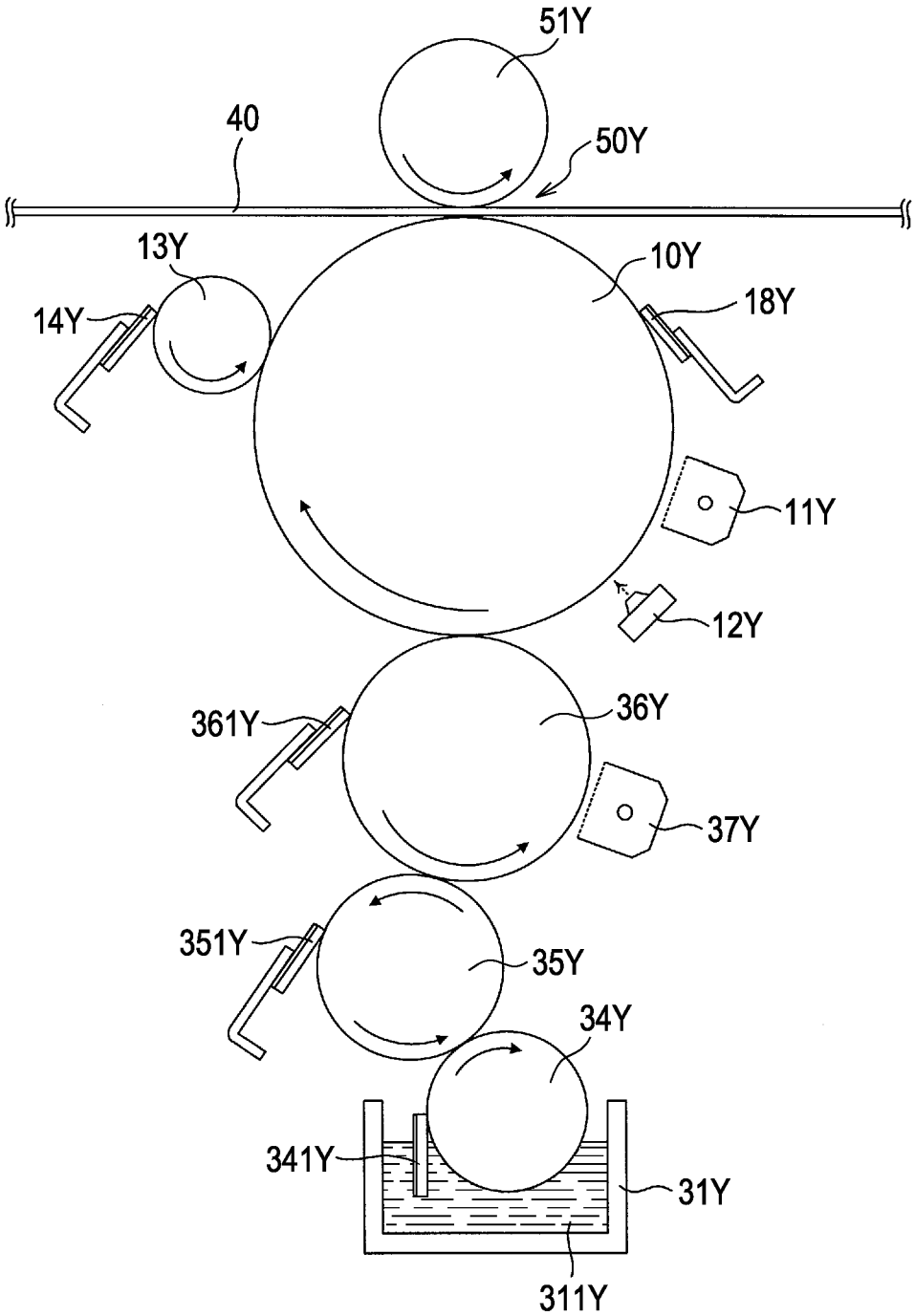
FIG. 2 is a cross-section view illustrating main constituents of an image forming section and a developing section according to the embodiment of the invention.

Next, the image forming section and the developing device according to the embodiment of the invention will be described. FIG. 2 is a cross-section view illustrating the main constituents of the image forming section and the developing device 30. Since the configurations of the image forming sections and the developing devices of each color are identical with each other, the configurations are described on the basis of the image forming section and the developing device of yellow (Y), and subscript alphabets are omitted.

An image carrier cleaning section 18, a corona charger 11, an exposure unit 12, a developing roller 36, and an image carrier squeeze roller 13 are disposed in the outer circumference of the image carrier 10 along the rotational direction thereof. An image carrier squeeze roller cleaning section 14 is disposed in the image carrier squeeze roller 13 as an appendage in the state where a blade thereof is in contact with the image carrier squeeze roller cleaning section. In addition, the primary transfer backup roller 51 of the primary transfer section 50 is disposed in a position opposite to the image carrier 10 along the intermediate transfer body 40.

The image carrier 10 is a photoreceptor drum which has a width wider than that of the developing roller 36 and is composed of a cylindrical member where a photosensitive layer is formed at the outer circumference surface. For example, as shown in FIG. 2, the image carrier rotates in a clockwise direction. The photosensitive layer of the image carrier 10 is constituted by amorphous silicon or an organic photo conductor and the like. The corona charger 11 is disposed at the upstream side of a rotational direction of the image carrier 10 from a nip portion of the image carrier 10 and the developing roller 36, and performs corona charging of the image carrier 10 by an applied voltage from a power supply device which is not shown. The exposure unit 12 illuminates light to the image carrier 10 charged by the corona charger 11 at the downstream side of a rotational direction of the image carrier 10 from the corona charger 11, and forms an electrostatic latent image on the image carrier 10.

The developing device 30 includes the developing roller 36, the intermediate roller 35, the feed roller 34, the developer container 31 storing the liquid developer in the state where toner is dispersed within the carrier to a degree of about weight ratio 20%, and a toner charger 37 which charges toner on the developing roller 36, as main components. A cleaning blade 361, the intermediate roller 35, and the toner charger 37 are disposed at the outer circumference of the developing roller 36. The surface of the intermediate roller 35 is in contact with the developing roller 36 and the feed roller 34, and an intermediate roller cleaning section 351 is disposed at the outer circumference of the intermediate roller. A regulating member 341 which adjusts the amount of the liquid developer drawn up from a developer reservoir 311 is in contact with the feed roller 34. Meanwhile, in a three-roller type using the intermediate roller 35 as in the developing device according to the embodiment, since the intermediate roller 35 is in contact with the feed roller 34 to thereby adjust the amount of the liquid developer, this regulating member 341 may be omitted.

The liquid developer transported to the developer reservoir 311 is not a volatile liquid developer generally used in related art, which has low-density (1 to 2 wt %) and low-viscosity using Isopar (trademark: Exxon Corporation) as a carrier, and is volatile at ordinary temperatures, but a high-density and high-viscosity liquid developer, in which solid particles made by dispersing colorants such as a pigment into a nonvolatile resin at ordinary temperatures and having an average particle diameter of 1 μm, is added to a liquid solvent such as an organic solvent, silicon oil, mineral oil or cooking oil along with a dispersant, so as to have a high viscosity (approximately 30 to 10000 mPa·s) of about 20% solid content concentration of the toner.

The feed roller 34 ("feed member" in the invention) has a function of feeding the liquid developer to the intermediate roller 35. This feed roller 34 is a cylindrical member, and a roller in which a groove portion such as a spiral groove carved finely and uniformly in a spiral shape on the surface is formed so as to be easy to carry the liquid developer on the surface. The liquid developer drawn up in this groove is precisely measured by the contacting regulating member 341 and is fed to the intermediate roller 35. At the time of operation of the device, as shown in the drawing, a transporting screw 33 rotates clockwise, and feeds the liquid developer to the feed roller 34. And then the feed roller 34 rotates clockwise, and apples the liquid developer to the intermediate roller 35.

The regulating member 341 is a metal, or an elastic blade of which the surface is coated with an elastic material. In the embodiment, the regulating member is constituted by a rubber portion composed of urethane rubber and the like which is in contact with the surface of the feed roller 34, and a plate composed of a metal and the like supporting the rubber portion. The film thickness and amount of the liquid developer carried and transported by the feed roller 34 are regulated and adjusted, and the amount of the liquid developer fed to the intermediate roller 35 is adjusted. Meanwhile, a regulating roller constituted by rollers may be used in place of this regulating member 341.

The developing roller 36 ("developer carrier" in the invention) is a cylindrical member, and rotates counterclockwise around the rotational axis as shown in FIG. 2. The developing roller 36 is provided with an elastic layer such as a polyurethane rubber, silicon rubber, NBR, and PFA tube in the outer circumference of the inner core made of a metal such as iron. The developing roller cleaning blade 361 is composed of rubber and the like being in contact with the surface of the developing roller 36, is disposed at the downstream side of a rotational direction of the developing roller 36 from a developing nip portion in which the developing roller 36 is in contact with the image carrier 10, and scrapes the liquid developer remaining in the developing roller 36 to remove it.

The intermediate roller 35 ("second feed member" in the invention) is a cylindrical member, rotates counterclockwise around the rotational axis as shown in FIG. 2 similarly to the developing roller 36, and is in counter contact with the developing roller 36. The intermediate roller 35 is provided with an elastic layer in the outer circumference of the inner center made of a metal, similarly to the developing roller 36.

The intermediate roller cleaning section 351 is disposed downstream of a position in which the intermediate roller 35 is in contact with the developing roller 36 in the state where the blade thereof is in contact with the intermediate roller 35, and scrapes the liquid developer which was not fed to the developing roller 36 to recover it to a recovery liquid reservoir.

The toner charger 37 ("charging member" in the invention) is an electric field applying means which increases a charging bias of the surface of the developing roller 36. The liquid developer transported by the developing roller 36 is charged due to the application of an electric field by corona discharge at a position close to this toner charger 37.

On the other hand, the liquid developer, which is carried in the developing roller 36 and charged, is developed in response to the electrostatic latent image of the image carrier 10 by a desired electric field in the developing nip portion in which the developing roller 36 is in contact with the image carrier 10. The developer which has not contributed to development is scraped by the developing roller cleaning blade 361 and is dropped to the recovery liquid reservoir. The density of the dropped developer is adjusted by a liquid developer density adjusting section, and is reused by being again supplied to the developer reservoir 311.

The image carrier squeeze device disposed at the upstream side of the primary transfer is disposed at the downstream side of the developing roller 36 facing the image carrier 10. The image carrier squeeze device is a device which recovers surplus developer of a toner image developed in the image carrier 10, and is constituted by the image carrier squeeze roller 13 composed of an elastic roller member of which the surface is coated with an elastic material and which rotates in contact with the image carrier 10, and a cleaning blade 14 which cleans the surface by pressing and sliding in the image carrier squeeze roller 13. Further, the image carrier squeeze device has a function of recovering an extra carrier from the developer developed in the image carrier 10, and raise the toner particle ratio within a visual image. As an image carrier squeeze device before the primary transfer, although one image carrier squeeze roller 13 is provided in the embodiment, a plurality of image carrier squeeze rollers may be provided. In this case, the image carrier squeeze roller separated and contacted in accordance with a state of the liquid developer may be configured to be changed over.

In the primary transfer section 50, a developer image developed in the image carrier 10 is transferred to the intermediate transfer body 40 by the primary transfer backup roller 51. Here, the image carrier 10 and the intermediate transfer body 40 moves at a uniform velocity, so that a drive load of rotation and movement is reduced, and a disturbance action on the toner image of a visual image of the image carrier 10 is suppressed.

The image carrier cleaning section 18 is a member disposed downstream of the primary transfer section 50 facing the image carrier 10, and causes the blade thereof to be in contact with the image carrier 10, so that transfer residual liquid developer or non-transfer liquid developer on the image carrier 10 is cleaned. The liquid developer scraped by the image carrier cleaning section 18 falls vertically downward, and drops to the recovery liquid reservoir.

Figure 3:
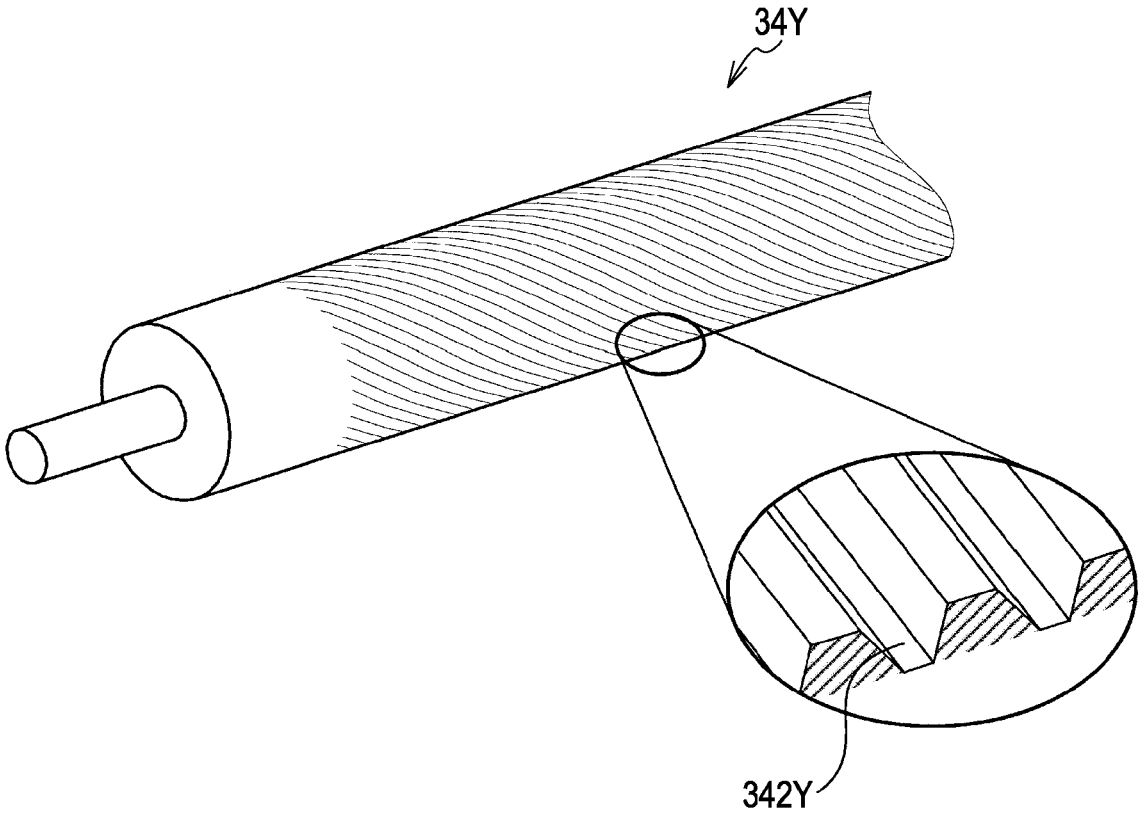
FIG. 3 is a perspective view of a feed roller according to the embodiment of the invention.
Figure 4:
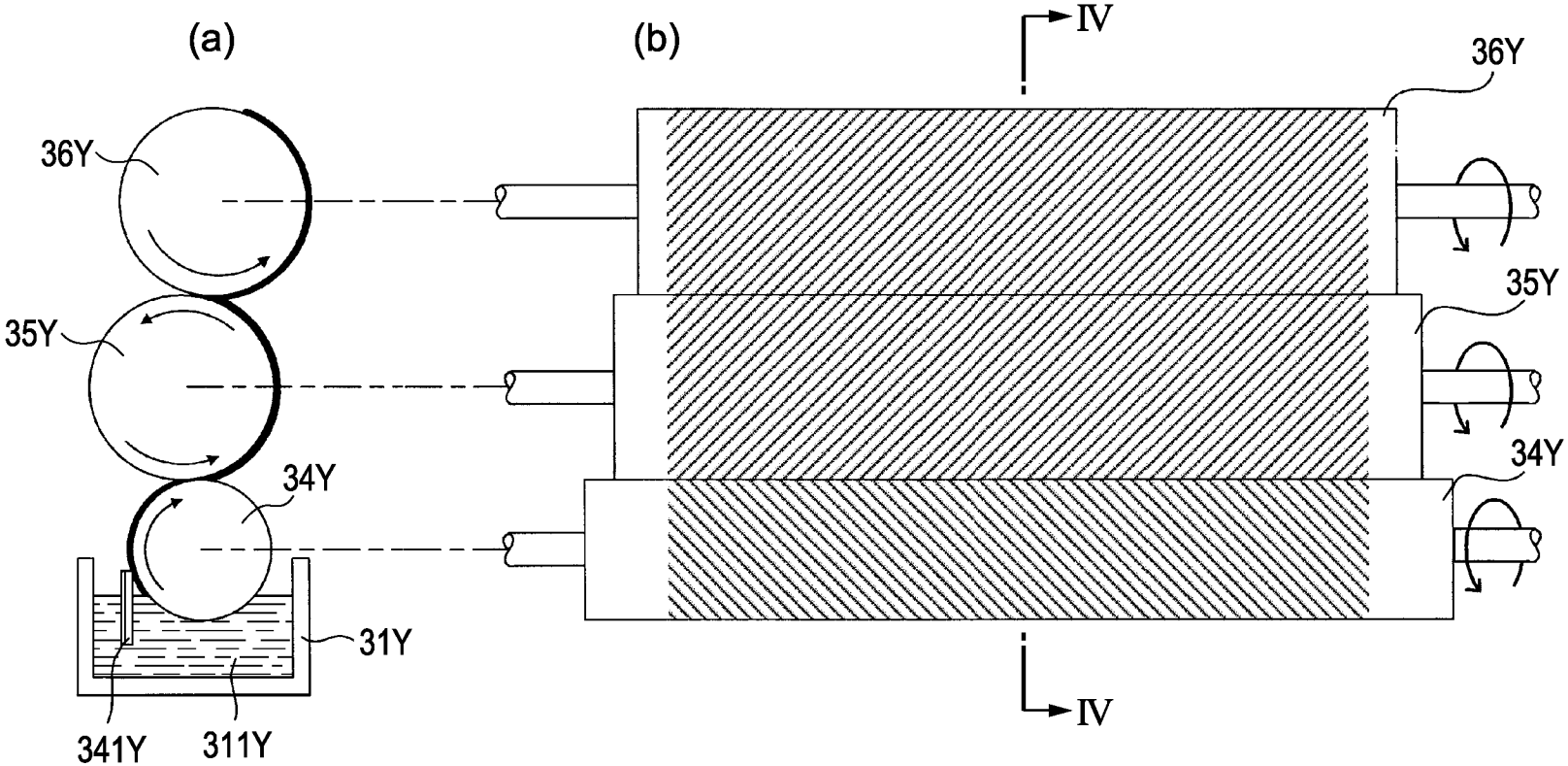
FIG. 4 is a diagram illustrating a state of transfer of liquid developer in a developing device according to the embodiment of the invention.

As describe above, the image forming apparatus according to the embodiment of the invention has been described, and reference is next made to FIG. 3 and FIG. 4 to describe a developer pattern generated by the feed roller ("feed member" in the invention) which is a cause of image unevenness.

FIG. 3 is a perspective view of the feed roller 34 used in the invention, and is a partially enlarged view thereof. The feed roller 34 according to the invention is provided with a recess pattern forming region in the surface central portion thereof as shown by diagonal lines of the drawing. This, recess pattern forming region is intended for the precise measurement of the liquid developer and the improvement of feed efficiency. In the embodiment, a spiral groove 342 is adopted. The liquid developer drawn up through the groove 342 is fed to the intermediate roller 35 which is in contact with the feed roller 34.

Next, reference is made to FIG. 4 to describe a state of the developer pattern formed by the groove 342 of the feed roller 34. Part (a) of FIG. 4 is a cross-section view of the developing device, and part (b) of FIG. 4 is a diagram illustrating a state of the developer pattern in each roller. Part (a) of FIG. 4 is a cross-section view taken along the line IV-IV in part (b) of FIG. 4, and the thick lines indicated on the surfaces of the feed roller 34, the intermediate roller 35, and the developing roller 36 show states where the liquid developer drawn up from the developer reservoir 311 is transferred. Meanwhile, the configuration of the periphery of each roller is omitted in the same drawing.

First, the liquid developer reserved in the developer reservoir 311 is drawn up by the feed roller 34 which rotates clockwise, and the amount thereof applied to the surface is regulated by the regulating member 341 which is in contact with the feed roller 34. The liquid developer applied to the feed roller 34 rotates counterclockwise, and is fed to the intermediate roller 35 which is in contact with the feed roller 34 in a forward direction. The liquid developer fed to the intermediate roller 35 rotates counterclockwise, and is fed to the developing roller 36 which is in contact with the intermediate roller 35 in a reverse direction. The liquid developer fed to the developing roller 36 develops the latent image on the image carrier 10, which is not shown, to form an image.

Since the groove 342 is formed on the surface of the feed roller 34 according to the embodiment, the liquid developer drawn up by the feed roller 34 forms a developer pattern of the liquid developer on the surfaces of the intermediate roller 35 and the developing roller 36. A state of transfer of the developer pattern is shown in part (b) of FIG. 4. Part (b) of FIG. 4 is a diagram when part (a) of FIG. 4 is viewed from a direction indicated by the symbol a, where states of the developer patterns of each roller are shown. When the groove 342 formed on the feed roller 34 is a diagonal pattern from top left to bottom right as shown the drawing, the developer patterns on the surfaces of the intermediate roller 35 and the developing roller 36 are as shown in the drawing. In particular, a developer pattern from top left to bottom right is formed on the surface of the intermediate roller 35 which is in contact with the feed roller 34 in a forward direction, and a developer pattern from top left to bottom right is also formed on the surface of the developing roller 36 which is in contact with the intermediate roller 35 in a reverse direction.

In a state where the developer pattern by the groove 342 is transferred on the developing roller 36 in this manner, unevenness is generated in an image to be formed. Since the developer pattern depends on the viscosity of the liquid developer, when the developer pattern is generated due to variation in the viscosity of the liquid developer with various types of environmental changes, it is preferable to suppress this.

Figure 5:
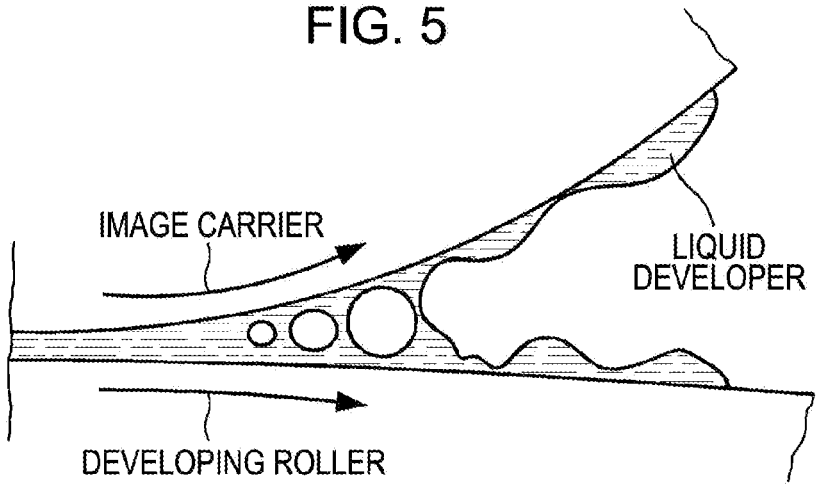
FIG. 5 is a diagram illustrating a state of transfer of the liquid developer from a developing roller to an image carrier.

Next, the developer stripe (rivulet) which is one more cause of image unevenness will be described in detail with reference to FIG. 5 and FIG. 6. FIG. 5 is a diagram illustrating a state of movement of the liquid developer between the image carrier 10 and the developing roller 36. As shown in the drawing, the image carrier 10 and the developing roller 36 develop the latent images, which move in the same direction and are formed on the image carrier 10, by the liquid developer applied to the surface of the developing roller 36. When developing, the liquid developer moves from the developing roller 36 to the image carrier 10. However, the phenomenon occurs that the fluid behavior of the liquid developer is disordered in the vicinity of a nip outlet between the developing roller 36 and the image carrier 10, and that the liquid developer moves apart while cobwebbing.

Figure 6:
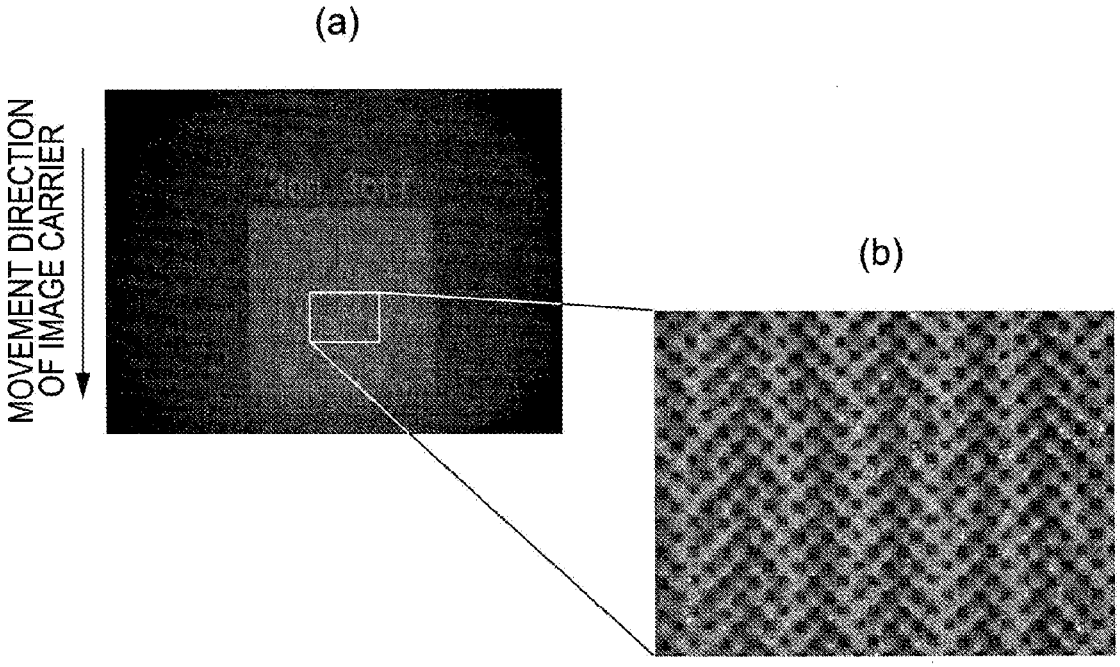
FIG. 6 is a diagram illustrating a developer stripe in a test image on the image carrier.

FIG. 6 shows disorder of an image on the image carrier 10 due to this phenomenon. Part (a) of FIG. 6 is a test image formed on the image carrier 10 (also called a patch image of AM screen, 283 lines, 50% halftone dot (1200 dpi, 3×3 lattice)). In addition, part (b) of FIG. 6 is a partially enlarged view of the test image. The test image, if it is a normal state, becomes an image having uniform gradation, but as viewed in part (b) of FIG. 6 when the previous phenomenon occurs, gradation of the image occurs in a movement direction and a vertical direction (lateral direction of the drawing) of the image carrier 10, and the test image becomes an image including the developer stripe like a brooklet (rivulet) along a movement direction of the image carrier 10.

Similarly to the developer pattern, this developer stripe also affects even the image transferred to the recording material such as paper, and appears as image unevenness in the transferred image. It is preferable to suppress the generation of the developer stripe, and improve the quality of the image.

The invention is characterized by suppressing the generation of the developer pattern and the developer stripe, and finally achieving the improvement in the quality of the image to be printed on the recording material. The invention is also characterized by adjusting the image density which varies when the generation of the developer pattern and the developer stripe is suppressed.

Figure 7:
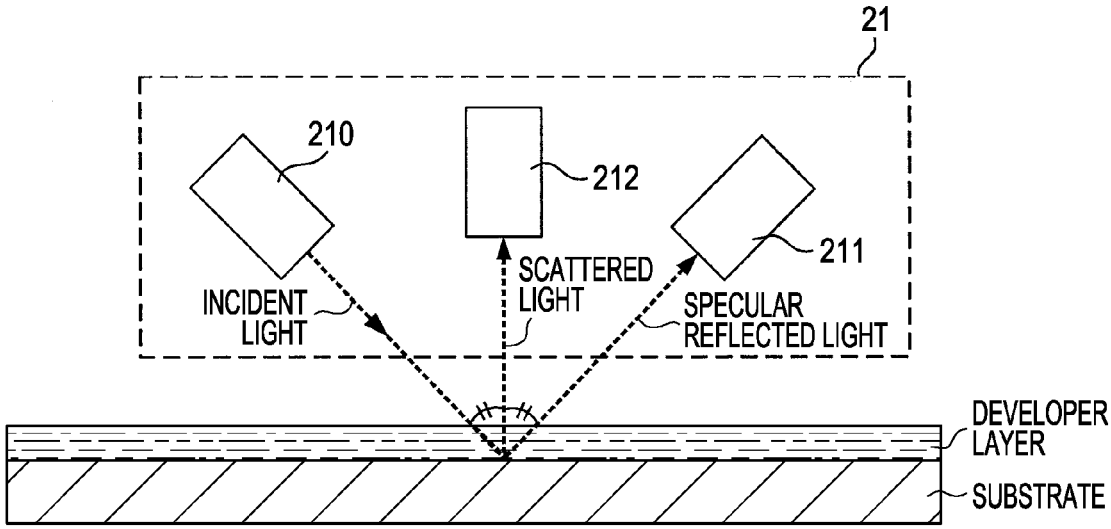
FIG. 7 is a diagram illustrating an optical sensor according to the embodiment of the invention.

The configuration according to the invention will be described with reference to FIG. 7 to FIG. 9. FIG. 7 is a diagram illustrating an optical sensor 21 used in the embodiment of the invention. The optical sensor 21 includes a light emitting section 210, a first light receiving section 211, and a second light receiving section 212 as constituents thereof. The light emitting section 210 is constituted by light-emitting elements such as an LED, and illuminates light at a predetermined incidence angle with respect to the substrate (direction of the incident light shown by arrows in the drawing).

The first light receiving section 211 is a sensor provided for detecting the image density by a developer layer applied to the substrate surface. The detection of the image density is performed using the characteristics that when the image density is high the specular reflected light decreases, and reversely when the image density is low the specular reflected light is large. Since the specular reflected light is taken efficiently, the specular reflected light is preferably disposed at a position where the reflection angle and the incidence angle become equal to each other.

The second light receiving section 212 is a sensor provided for detecting unevenness of the developer layer applied to the substrate surface. The detection of unevenness of the developer layer is performed using characteristics that when unevenness occurs in the developer layer the scattered light increases, and reversely when unevenness does not exist the scattered light decreases. In the embodiment, it is possible to detect the scattered light with good efficiency by disposing the second light receiving section 212 vertically upward of the incident position of the light.

Figure 8:
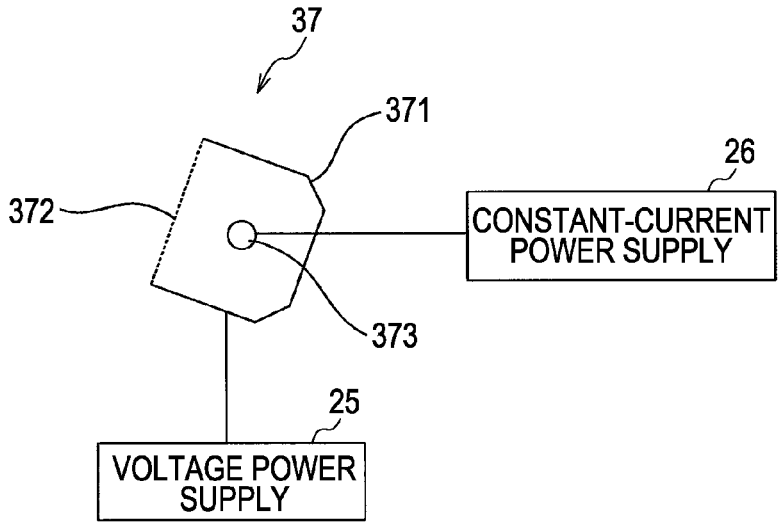
FIG. 8 is a diagram illustrating a toner charger according to the embodiment of the invention.
Figure 9:
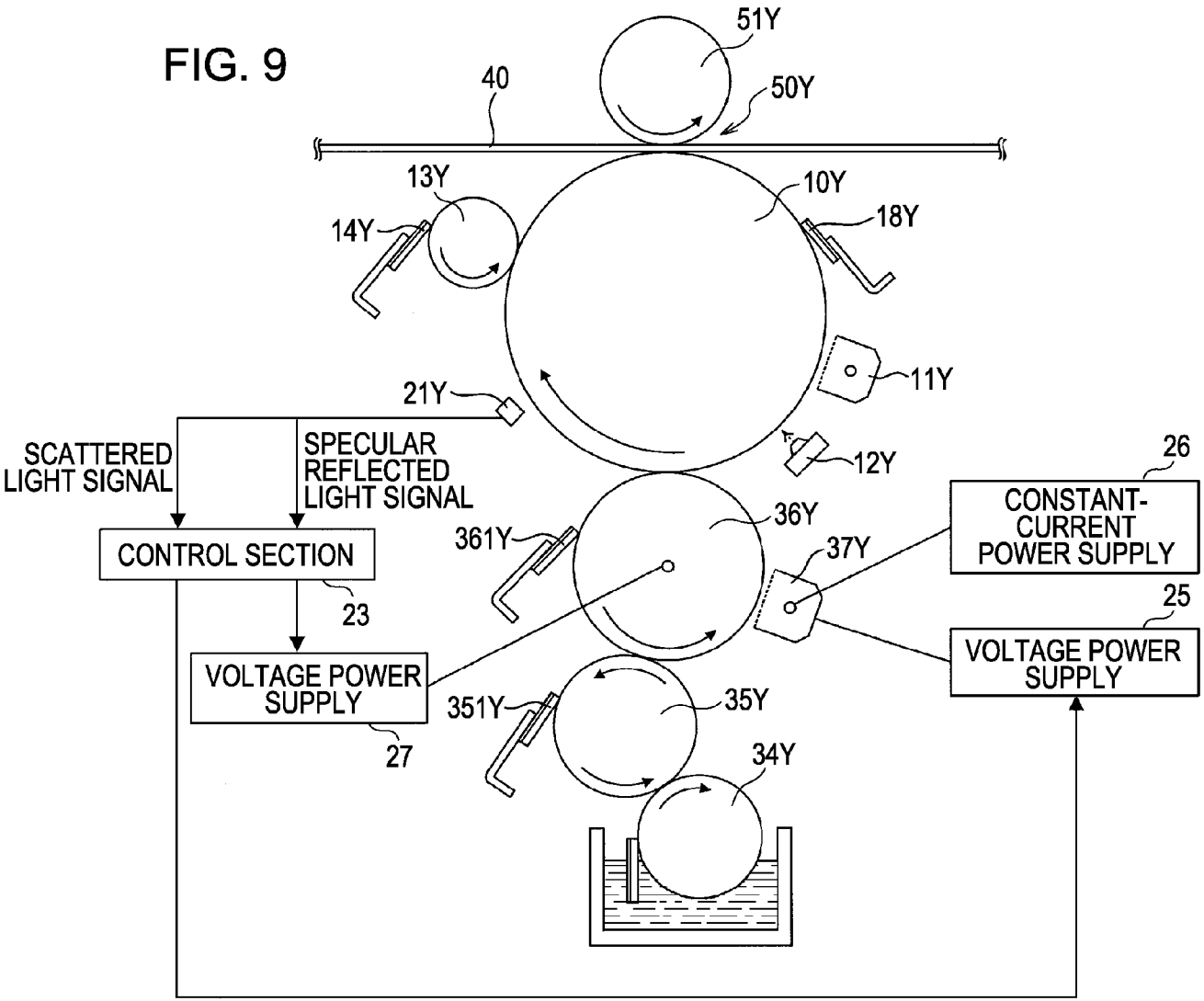
FIG. 9 is a diagram illustrating a control operation of the image forming apparatus according to the embodiment of the invention.

FIG. 8 is a diagram illustrating the toner charger 37 used in the embodiment of the invention. The toner charger 37 is a member which charges toner on the developing roller 36, and uses, for example, a scorotron which performs charging by charged ions similarly to the corona charger 11 disposed at the image carrier 10. In the meantime, for the toner charger 37, not only the scorotron, but also various types of toner chargers may be adopted such as a contact-type toner charger which charges a roller or a blade by contact.

The toner charger 37 using the scorotron is constituted by a shield 371, a grid 372, and a metal wire 373. A constant-current power supply 26 is connected to the metal wire 373, and a certain amount of charge is emitted from the metal wire 373. In the embodiment, a value of the constant-current power supply is set to 2 [μA/mm]. The grid 372 is in a conduction state with the shield 371, and a voltage from a voltage power supply 25 connected to the shield 371 is applied without change. A voltage applied to the grid 372 controls how many charges out of charges emitted from the metal wire 373 pass to the toner side on the developing roller 36.

The charge amount of toner is a value which is determined by a voltage Vd applied to the developing roller 36 and a grid voltage Vg applied to the grid 372, and is an amount proportional to the difference Vg-Vd of each voltage. In the toner charger 37 using the scorotron, the charge amount is adjusted by changing the grid voltage Vg used as a bias. In the embodiment, a representative value of Vd is set to 300 [V], and a representative value of Vg is set to 375 [V]. In the meantime, when the toner charger 37 of the type other than the scorotron is used, a bias for adjusting the charge amount is adjusted in accordance with the type.

When the charge amount of toner is small, the transfer property of toner from the developing roller 36 to the image carrier 10 deteriorates, which causes image unevenness to easily occur. On the other hand, when the charge amount of toner is large, the transfer property of toner from the developing roller 36 to the image carrier is improved, which causes image unevenness to be hard to occur. However, since the toner is agglutinated when the charge amount of toner is set to be excessively large, it is necessary to adequately maintain the charge amount of toner required for suppressing the occurrence of image unevenness.

The invention achieves the improvement in quality of the image to be printed using the relationship between the charge amount of toner and the occurrence of image unevenness. The control of image forming apparatus according to the embodiment of the invention will be described. FIG. 9 is a diagram illustrating an example of the control of the image forming apparatus using the optical sensor 21 described in FIG. 7 and the toner charger 37 described in FIG. 8. On the image carrier 10, the optical sensor 21 is disposed at a position where the image developed on the developing roller 36 can be detected. In the embodiment, although the optical sensor is disposed before passing through the squeeze roller 13, it may be disposed after passing through the squeeze roller 13 and before passing through the primary transfer section 50.

The optical sensor 21 disposed in this manner illuminates light to the surface of the image carrier 10 which becomes a substrate, and performs the detection of the specular reflected light signal and the scattered light signal. The detected scattered light signal is used for adjustment of image unevenness. In the embodiment, the grid voltage of the toner charger 37 is adjusted, to thereby cause the occurrence of image unevenness to be suppressed.

On the other hand, variation occurs in the image density on the image carrier 10 in accordance with adjustment of the charge amount of toner. In addition, the image density is concomitant with variation even by the change of peripheral environment such as temperature, or the developer deterioration and the like. For printing a good image, it is also necessary to appropriately adjust the image density in addition to the suppression of image unevenness. In the embodiment, the image density on the image carrier 10 is detected by the optical sensor 21, and the image density is uniformly maintained by adjusting a voltage (developing bias) applied to the developing roller 36.

Since the transfer rate of the developer from the developing roller 36 to the image carrier 10 is in a proportional relation with a voltage applied to the developing roller 36, it is possible to control the amount of application of the liquid developer to the image carrier 10 by adjusting the voltage applied to the developing roller 36. In the embodiment, a transfer rate from the developing roller 36 to the image carrier 10 is changed (when beta printing) to 60 to 90 [%] by setting the voltage applied to the developing roller 36 to 200 to 400 [V], which allows the image density to be adjusted.

In particular, when the signal of the specular reflected light received in the first light receiving section 211 is large, that is, the image density is small, the voltage applied to the voltage power supply 27 is raised, so that the application amount is increased and the image density is increased. On the other hand, when the signal of the specular reflected light received in the first light receiving section is small, that is, the image density is large, the voltage applied to the voltage power supply 27 is dropped, so that the application amount is decreased and the image density is decreased.

When the voltage applied to the developing roller 36 is varied, it is necessary to also change the grid voltage of the toner charger 37 by variation of the voltage of the developing roller 36, since the charge amount by the toner charger 37 is made uniform.

Figure 10:
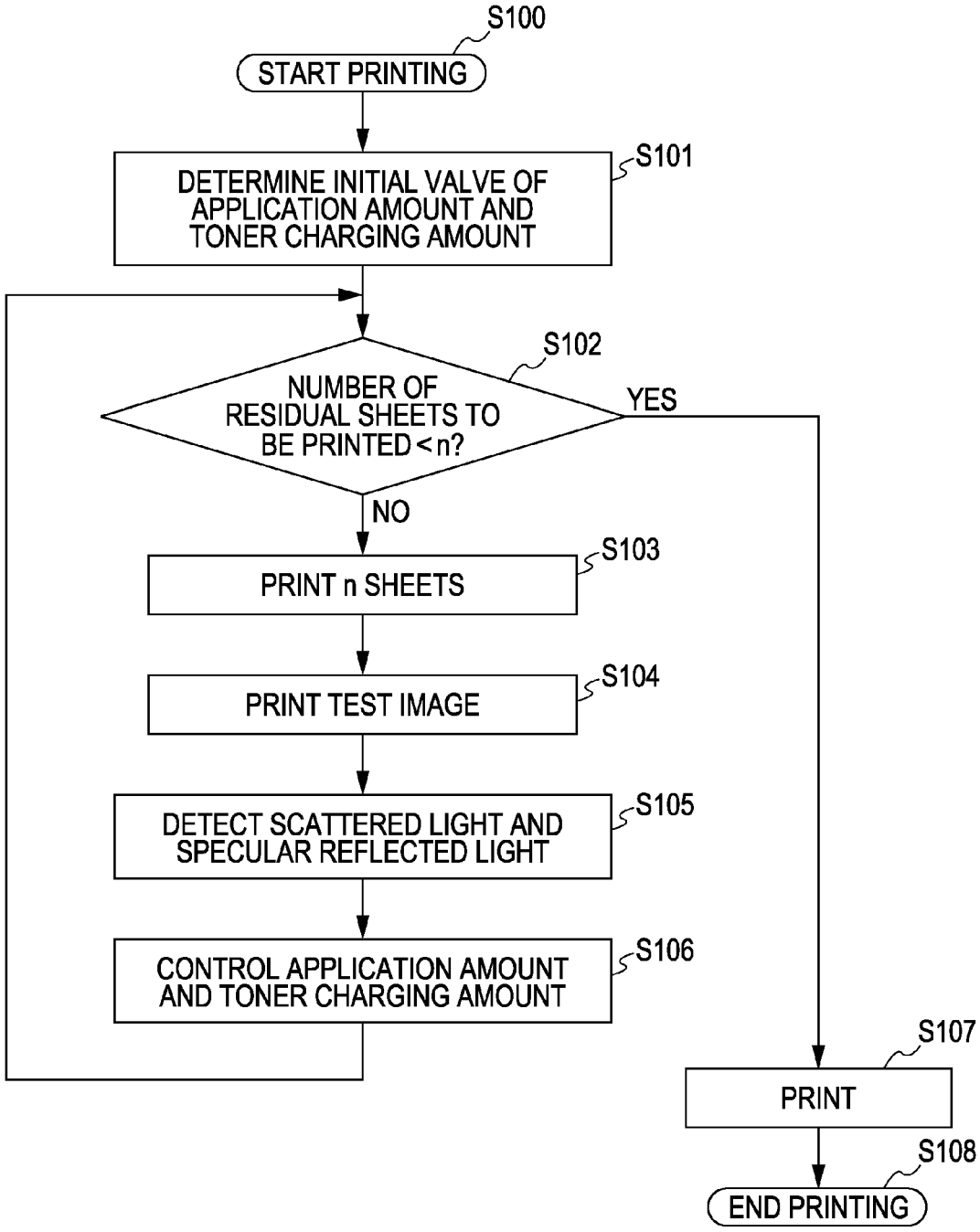
FIG. 10 is a flow diagram of a control operation of the image forming apparatus according to the embodiment of the invention.
Figure 12:
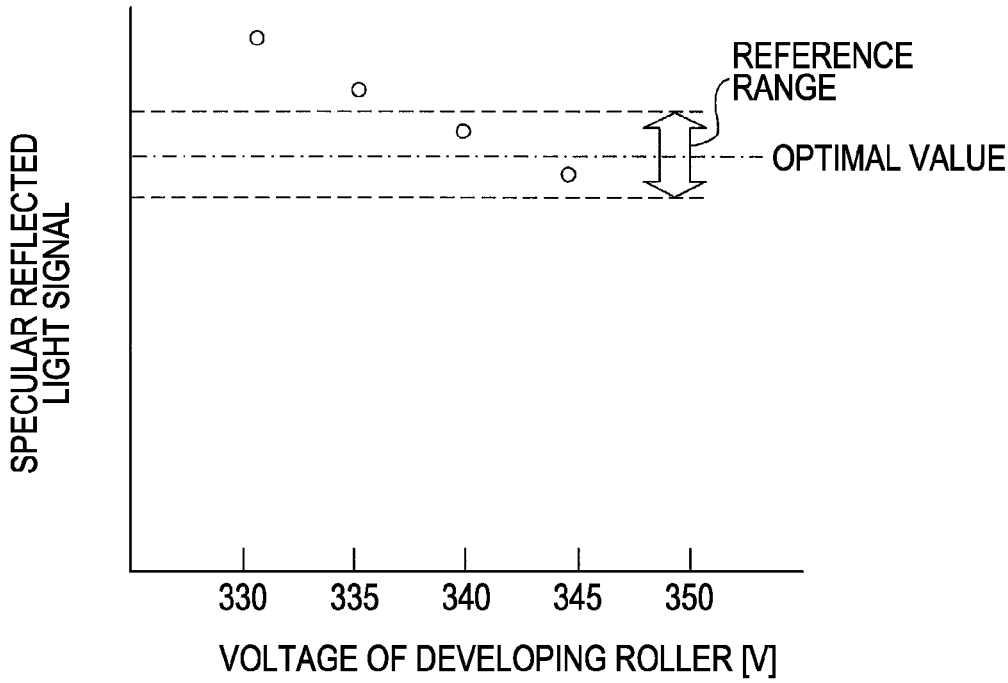
FIG. 12 is a diagram illustrating the relationship between a developing roller voltage and a specular reflected light receiving signal.
Figure 13:
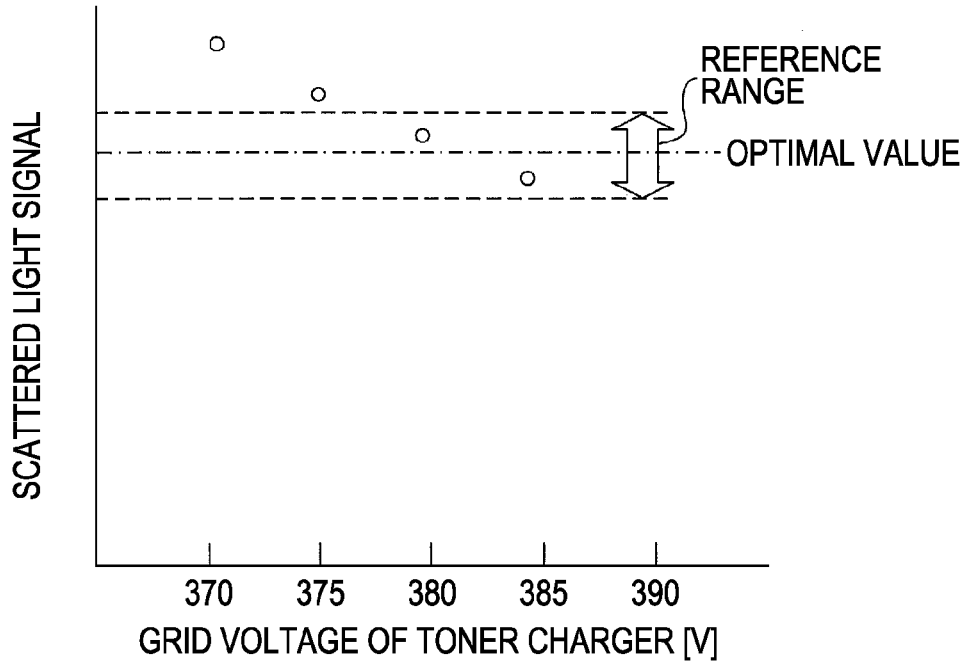
FIG. 13 is a diagram illustrating the relationship between a grid voltage of a toner charger and a scattered light receiving signal.

The control of the image forming apparatus according to the embodiment of the invention will be described with reference to FIG. 10 to FIG. 13. FIG. 10 is a flow diagram illustrating the control of the image forming apparatus, FIG. 11 is a table used in the control of the image forming apparatus, FIG. 12 is a diagram illustrating the relationship between the developing roller voltage and the specular reflected light signal, and FIG. 13 is a diagram illustrating the relationship between the grid voltage of the toner charger and the scattered light receiving signal.

In the flow diagram of FIG. 10, when printing is started (S100), first, each initial value of the application amount in S101, that is, a voltage applied to the developing roller 36, and the charge amount of toner, that is, a voltage applied to the toner charger 37, is determined. If more than a certain period of time (for example, an hour) does not lapse from the time of the end of the previous printing, the value used at the time of previous printing end is used. On the other hand, when more than a certain period of time lapses, each initial value is determined in a second adjusting process described later. In this manner, when more than a certain period of time does not lapse, the second adjusting process is omitted, to thereby allow the whole process to be simplified.

In S102, it is determined whether the number of the residual printing sheets is smaller than that of n sheets (for example, five sheets). When it is determined to be larger than the number of the n sheets, after the printing operation is performed on n printing sheets in S103, an adjusting process from S104 to S106 is performed. As described above, in the embodiment, an adjustment of image unevenness and the image density is executed every time the printing operation of the recording material is performed on n printing sheets. On the other hand, when the number of the residual printing sheets is determined to be smaller than that of n sheets in S102, after the printing operation is performed on the number of the residual sheets in S107, the printing operation is ended (S108).

The adjusting process from S104 to S106 will be described in detail. First, a test image (also called a patch image) is printed outside of an image region of the image carrier 10 in S104. Although proper images such as a painting-out image (beta patch) or a lattice-shaped image (screen patch) may be used in this test image, it is preferable to use the painting-out image in order to detect image unevenness more accurately. Meanwhile, instead of using such a test image, proper places appropriate to detecting image unevenness and the image density may be used among images used for printing. In this case, it is possible to detect image unevenness and the image density during printing in S103, thereby allowing a process of S104 to be omitted.

In S105, light is illuminated from the light emitting section 210 with respect to the test image printed in S104, and then the specular reflected light is received by the first light receiving section 211, and the scattered light is received by the second light receiving section 212 as well. The specular reflected light and the scattered light which are received are converted into the specular reflected light signal and the scattered light signal such as, for example, a voltage value by the optical sensor 21 and are used for the control.

The specular reflected signal and the scattered light signal which are output from the optical sensor 21 are converted into a control signal of the voltage power supply 27 for controlling the applied voltage of the developing roller 36, and a control signal of the voltage power supply 25 for controlling the grid voltage of the toner charger 37 by the control section 23.

The control of the image density in the embodiment will be described. FIG. 12 is a diagram illustrating the relationship between the output value of the specular reflected light signal and the voltage of the developing roller. A reference range including an optimal value is set up in the specular reflected light signal. In the embodiment, the image density is appropriate provided that the output value of the specular reflected light signal is within this reference range, and the voltage applied to the developing roller 36 is controlled so that the output value of the specular reflected light signal is within the reference range.

When the output value of the specular reflected light signal exceeds the upper limit of the reference range, the image density is determined to be excessively small, and the control signal for the voltage power supply 27 is changed so as to raise the voltage of the developing roller 36. When the voltage applied to the developing roller 36 is negative, the control signal is changed so as to drop the voltage thereof. In other words, the voltage applied to the developing roller 36 is controlled so as to increase in absolute value. On the other hand, when the output value of the specular reflected signal falls short of the lower limit of the reference range, the image density is determined to be excessively large, and the control signal for the voltage power supply 27 is changed so as to drop the voltage of the developing roller 36 (so as for the voltage of the developing roller 36 to decrease by an absolute value).

In the embodiment, when the output value of the specular reflected light signal exceeds the upper limit of the reference range, the voltage applied to the developing roller 36 is raised by 5 [V], and when the output value of the specular reflected light signal falls short of the lower limit of the reference range, the voltage applied to the developing roller 36 is dropped by 5 [V]. In addition, since the charge amount by the toner charger 37 is made uniform, the grid voltage of the toner charger 37 is also varied by variation of the voltage applied to the developing roller 36.

Next, the control of image unevenness in the embodiment will be described. FIG. 13 is a diagram illustrating the relationship between the output value of the scattered light signal and the grid voltage of the toner charger 37. The reference range including an optimal value is set up in the output value of the scattered light signal. In the embodiment, when the output value of the scattered light signal is within this reference range, image unevenness is in an allowable range, control of the grid voltage of the toner charger 37 is performed so that the scattered light signal is within the reference range.

When the output value of the scattered light signal exceeds the upper limit of the reference range, image unevenness is determined to exceed the allowable range, and the control signal for the voltage power supply 25 is changed so as to raise the grid voltage of the toner charger 37. When the grid voltage is set to be negative, the control signal is changed so as to drop the grid voltage. In other words, the grid voltage of the toner charger 37 is controlled so as to increase in absolute value. On the other hand, when the output value of the scattered light signal falls short of the lower limit of the reference range, in order to avoid that the toner is excessively agglutinated, the control signal for the voltage power supply 25 is changed so as to drop the grid voltage of the toner charger (so as for the grid voltage of the toner charger 37 to decrease in absolute value).

In the embodiment, when the output value of the scattered light signal exceeds the upper limit of the reference range, the grid voltage is raised by 5 [V], and when the output value of the scattered light signal falls short of the lower limit of the reference range, the grid voltage is dropped by 5 [V], whereby the toner is excessively agglutinated and therefore image unevenness can be suppressed.

FIG. 11 shows a table used for the control of the control section 23 according to the embodiment. It is known that the control of nine patterns is performed by the combination of the scattered light signal and the specular reflected light signal. Two voltages written within parentheses in the column of the grid voltages denote that the right side thereof is a voltage value varied with the voltage variation of the developing roller 36, and the left side thereof is a voltage value controlled by the scattered light signal, respectively. In practice, the control is performed by the sum of these two voltage values (value written outside of parentheses).

As described above, in the embodiment, image unevenness is detected by detecting the output value of the scattered light signal of the image in the optical sensor 21, and the bias applied to the toner charger 37 is controlled so as to suppress image unevenness. The image density varied with the suppression control of image unevenness or various types of environmental changes is detected in the optical sensor 21, so that the image density is uniformly maintained in conjunction with the suppression of image unevenness, thereby allowing the high-quality image formation to be performed.

Figure 14:
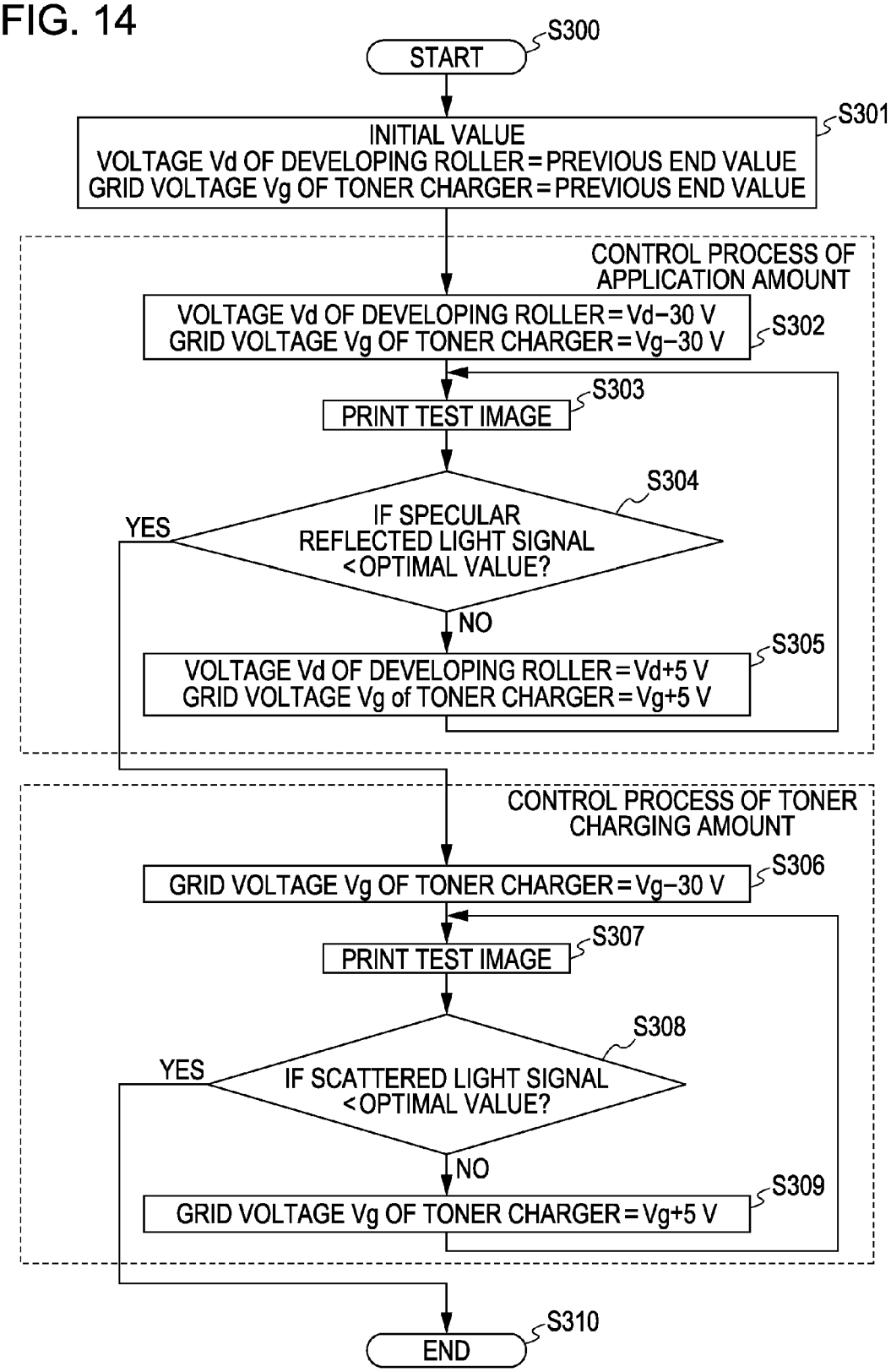
FIG. 14 is a flow diagram illustrating a control operation of the image forming apparatus according to another embodiment of the invention.

Next, reference is made to FIG. 14 to describe the second adjusting process according to the embodiment of the invention. In the embodiment, the second adjusting process is a process performed when more than a certain period of time lapses from the time of previous printing end in S101 of FIG. 10, and is a process for performing the adjusting process of the voltage applied to the developing roller 36 and the grid voltage of the toner charger 37 more accurately than the adjusting process of FIG. 10.

In the second adjusting process, first, the initial values of the voltage applied to the developing roller 36 and the grid voltage of the toner charger 37 are determined in S301. In the embodiment, each of these initial values is set to values of the time of the previous end. S302 to S305 are the control processes of the application amount, and are processes for making the application amount of the liquid developer be approximate to the optimal value by adjusting the voltage applied to the developing roller 36 in the embodiment.

In the control processes of the application amount, first in S302, the voltage applied to the developing roller 36 is lowered by a predetermined amount from the initial value (30 [V] in the embodiment). In addition, the grid voltage of the toner charger 37 is also lowered by the same predetermined amount concomitantly with the lowering of the voltage applied to the developing roller 36. Next, in S303, the test image is printed outside of the image region of the image carrier 10. The painting-out image (beta patch) or the lattice-shaped image (screen patch) and the like are used in the test image, similarly to S104 of FIG. 10.

In S304, it is determined whether the output value of the specular reflected light signal for the test image falls short of the optimal value as shown in FIG. 12. When the output value is determined to fall short of the optimal value, the voltage applied to the present developing roller 36 is determined to be a value used in the control practically, and the grid voltage of the present toner charger 37 is adopted as the initial value of the control process of the charge amount of toner, and then the control process of the application amount is ended. On the other hand, when the output value is determined not to fall short of the optimal value, the process returns to S303 after the voltage applied to the developing roller 36 and the grid voltage of the toner charger 37 are raised by a predetermined amount (5 [V] together in the embodiment) in S305.

As described above, in the process, after the voltage applied to the developing roller 36 is lowered once, the voltage of the developing roller 36, which becomes optimal by raising it by predetermined amounts, is searched for. In the embodiment, although the voltage, which becomes optimal while raising the voltage, is searched for, the search of an optimal value may be performed while dropping the voltage.

In S304, if the output value of the specular reflected light signal falls short of the optimal value, and the voltage applied to the developing roller 36 is determined, the process proceeds to the control processes of the charge amount of toner of S306 to S309. In the processes, similarly to the control processes of the application amount, the search of a control value, which becomes optimal by sequentially shifting the control value by predetermined amounts, is performed.

In the control processes of the charge amount of toner, first in S306, the grid voltage of the toner charger 37 is lowered by a predetermined amount (30 [V] in the embodiment) from the initial value determined in the control process of the application amount. Next, in S307, the test image is printed outside of the image region of the image carrier 10, similarly to S303. In S308, it is determined whether the output value of the scattered light signal for the test image falls short of the optimal value as shown in FIG. 13. When the output value is determined to fall short of the optimal value, the present grid voltage is adopted as a value used for the control, and then the control process of the charge amount of toner is ended.

On the other hand, when the output value is determined not to fall short of the optimal value, the voltage of the toner charger 37 is raised by a predetermined amount (5 [V] in the embodiment) in S309, and then the process returns to S307. As described above, in the process, the grid voltage of the toner charger 37 is lowered once from the initial value, and then the search of the grid voltage, which becomes optimal by sequentially shifting the grid voltage by predetermined amounts, is performed. Meanwhile, even in the control process of the charge amount of toner, the search of the optimal value may be performed while dropping the grid voltage.

Figure 15:
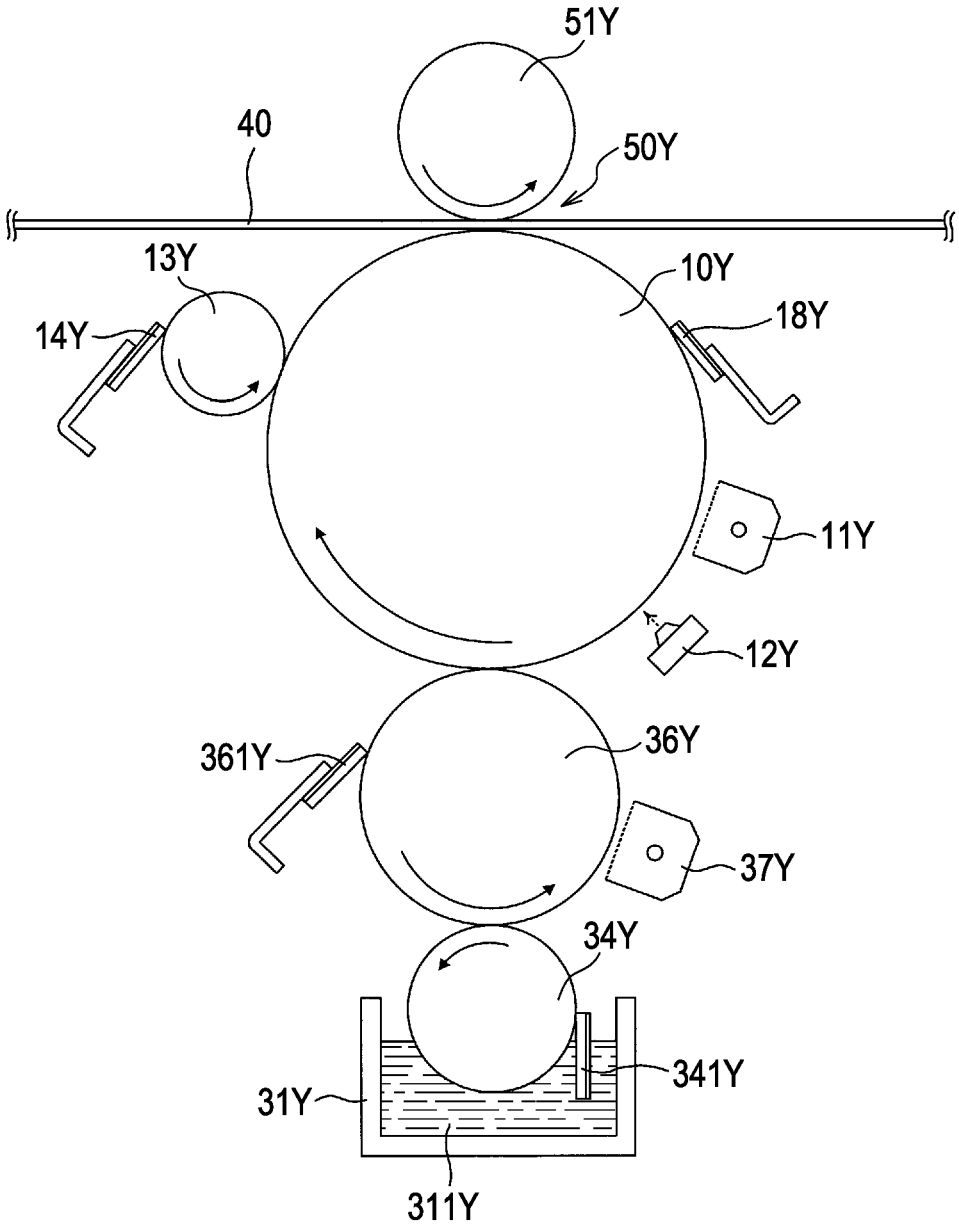
FIG. 15 is a cross-section view illustrating main constituents of the image forming section and the developing section according to another embodiment of the invention.

As stated above, although the second adjusting process according to another embodiment of the invention has been described, it is possible to perform the adjusting process more accurately than the adjusting process described in FIG. 10 by performing the control process of the application amount for determining the voltage applied to the developing roller 36 and the control process of the charge amount of toner for determining the grid voltage of the toner charger 37 separately in the second adjusting process. In the meantime, although the second adjusting process according to the embodiment is performed in order of the control process of the application amount and the control process of the charge amount of toner, it may be performed in order of the control process of the charge amount of toner and the control process of the application amount. Further, in the embodiment, although the amount sequentially shifted is set to a fixed predetermined amount, a process may be performed in which the predetermined amount is changed (for example, lowering 5 [V] to 1 [V] in the case of the grid voltage) after falling short of the optimal value or when being approximate to the optimal value, to thereby allow it to be approximate to a more optimal value. In addition, the invention is not limited to a three-roller type using the feed roller 34, the intermediate roller 35, and the developing roller 36 described in FIG. 2, and may be adopted in a two-roller type, described in FIG. 15, in which the feed roller 34 is in direct contact with the developing roller 36 to feed the liquid developer. In the three-roller type, since the liquid developer is well tempered at the contact portion of each roller, an advantage is exhibited that a uniform developer film is formed on the developing roller 36. Meanwhile, in the two-roller type, miniaturization of the whole device and low cost thereof can be achieved by simplifying the developing section 30.

As stated above, although various embodiments according to the invention have been described, the invention is not limited to only the embodiments, and embodiments constituted by the appropriate combination of configurations of each embodiment are included in the category of the invention as well.

The entire disclosure of Japanese Patent Application No: 2009-51001, filed Mar. 4, 2009 is expressly incorporated by reference herein.

What is claimed is:

1. An image forming apparatus comprising:

a developing section that includes a feed member having a groove, a developer carrier developing with liquid developer fed from the feed member, and a charging member charging the liquid developer carried on the developer carrier;

an image carrier that carries an image developed by the developer carrier;

an optical sensor that includes a light emitting section emitting light to the image developed on the image carrier, a first light receiving section receiving light reflected from the image, and a second light receiving section disposed at a position different from that of the first light receiving section; and a control section that adjusts a developing bias applied to the developer carrier by a first power supply in response to an output signal of the first light receiving section, and controls a bias applied to the charging member by a second power supply that is different the first power source and the charging member in response to the output signal of the first light receiving section and an output signal of the second light receiving section.

2. The image forming apparatus according to claim 1, wherein the control section sets the developing bias applied to the developer carrier to a first developing bias, when the output signal of the first light receiving section is a first output value, and wherein the control section adjusts the developing bias applied to the developer carrier to a second developing bias larger than the first developing bias in absolute value, when the output signal of the first light receiving section is larger than the first output value.

3. The image forming apparatus according to claim 1, wherein light detected by the first light receiving section is specular reflected light of the light reflected from the image, and light detected by the second light receiving section is scattered light of the light reflected from the image.

4. The image forming apparatus according to claim 1, wherein the control section performs adjustment of the developing bias applied to the developer carrier and adjustment of the bias applied to the charging member, after the predetermined number of recording materials is printed.

5. An image forming method comprising:

feeding liquid developer reserved in a developer reservoir to a developer carrier using a feed member having a groove;

charging the liquid developer fed to the developer carrier by a charging member;

developing a latent image formed on an image carrier by the developer carrier to which a developing bias is applied using the liquid developer charged by the charging member;

emitting light to the image developed by the developer carrier through a light emitting section, receiving light reflected from the image in a first light receiving section, and receiving the light reflected from the image in a second light receiving section disposed at a position different from that of the first light receiving section; and adjusting the developing bias applied to the developer carrier by a first power supply in response to an output signal of the first light receiving section, and adjusting a bias applied to the charging member by a second power supply that is different the first power source and the charging member in response to the output signal of the first light receiving section and an output signal of the second light receiving section.

6. The image forming method according to claim 5, further comprising:

setting the developing bias applied to the developer carrier to a first developing bias, when the output signal of the first light receiving section is a first output value; and adjusting the developing bias applied to the developer carrier to a second developing bias larger than the first developing bias in absolute value, when the output signal of the first light receiving section is larger than the first output value.

* * * * *